United States Patent [19]

Kennedy

[11] Patent Number: 4,648,519

[45] Date of Patent: Mar. 10, 1987

[54] VENTED CLOSURE

[75] Inventor: Kenneth R. Kennedy, Newburgh, Ind.

[73] Assignee: Sunbeam Plastics Corporation, Evansville, Ind.

[21] Appl. No.: 856,195

[22] Filed: Apr. 28, 1986

[51] Int. Cl.[4] ..... B65D 51/16

[52] U.S. Cl. ..... 215/261

[58] Field of Search ..... 215/261; 220/367, 373

[56] References Cited

U.S. PATENT DOCUMENTS 3,951,293 4/1976 Schulz ..... 215/261

4,093,105 6/1978 Russell et al. ..... 220/273

*Primary Examiner*—Donald F. Norton

*Attorney, Agent, or Firm*—Irvin L. Groh

[57] ABSTRACT

A container or bottle closure in the form of a one-piece cap. The cap is formed with a flat top and a depending skirt having means for attachment to the container neck such as internal threads which mate with complementary threads on the container. An annular flange depends downwardly from the cap top to act as a sealing between the closure and the container. A vent is provided through the cap top to equalize the container pressure to atmospheric pressure. The vent takes the form of a plurality of orifices created by a laser beam which produces a hole of a diameter of 0.003 inches or less. Gas may flow equally well from the inside of the container outwardly or from the outside of the container inwardly, depending upon the pressure difference. The orifice diameter is sufficiently small to prevent the flow of a liquid product through the holes under the same pressure difference.

6 Claims, 2 Drawing Figures

VENTED CLOSURE

Figure 1:
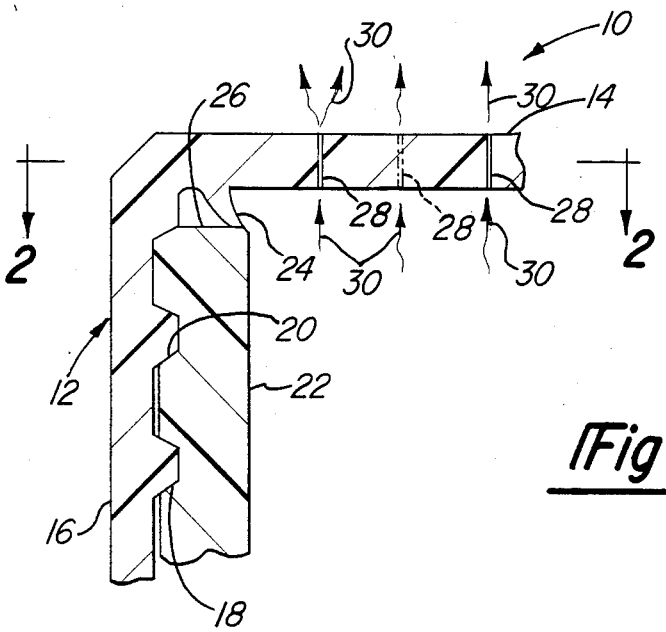

This invention relates to a container or bottle closure, and, more particularly to a standard threaded cap.

There are a wide variety of container closures available the simpliest of which is a cap having a flat top and a depending skirt. The skirt is normally provided with internal threads to engage complementary threads on the container neck. Usually some type of sealing means is provided between the cap and the container. This may take the form of a simple annular gasket which acts between the top of the cap and the top or rim of the container neck. Other forms of seals can take the form of an annular flange which acts between the inside or outside diameter of the container neck or may engage the top or lip of the container. When the container is filled with a product under heated conditions or is filled with a product which may have some chemical breakdown, releasing a gas, an undesirable pressure difference may exist between the inside and outside of the container. Aside from providing a check valve structure or rupture disc, there has been heretofore no simple means of equalizing this pressure once the cap has been applied to the container in a sealing manner.

It is, therefore, an object of this invention to provide a venting means on a simple one-piece closure cap.

It is another object of this invention to provide a venting means on a simple closure cap which allows in flow of atmospheric air into the container to equalize the pressure difference created by hot product sealing which establishes an initial vacuum in the package container.

It is another object of this invention to provide pressure release from the container through a simple cap when a pressure builds up in the container as by a change in the product such as the release of gas pressure from a chlorine containing product.

It is still another object of this invention to equalize gas pressure within the container through the closure cap without permitting the outflow of a liquid product contained therein.

The foregoing objects and other advantages of the present invention are accomplished in a venting closure which is a single piece cap having a flat top and a cylindrical skirt depending from the top. The skirt contains means for attachment to a container, normally in the form of internal threads which engage threads on the container or bottle neck. At least one cylindrical orifice extends through the top with the diameter of 0.003 inches or less which has been formed by a laser beam creating a smooth hole orifice of uniform diameter. Usually two or more orifices are machined by a laser beam in a random pattern on the cap top. A single orifice or a plurality of orifices of this diameter permits equalizing the pressure in the container with atmospheric pressure but will not allow any liquid to pass through the orifice under the action of the same pressure difference. The cap is sealed to the container in a conventional manner such as by an annular flange extending downwardly from the cap top which engages the top of the container neck.

Figure 2:
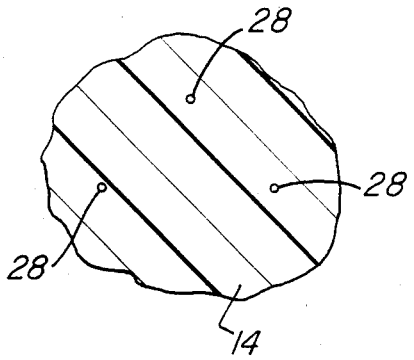

The present preferred embodiment is illustrated in the accompanied drawings in which:

FIG. 1 is a fragmentary elevational view in cross section showing a threaded cap engaged with a threaded container neck and embodying the vent orifices of this invention; and FIG. 2 is a fragmentary plan view in section taken along line 2—2 of FIG. 1 showing the random distribution of the vent orifices.

Closure 10 is shown as a one-piece cap 12 having a flat top 14 and a cylindrical depending skirt 16 which has internal threads 18 engaging threads 20 on container neck 22.

Depending from the top 14 of cap 12 is an annular flange 24 which acts as a sealing member to engage the top 26 of container neck 22 completely sealing the cap to the container.

Machined in top 14 by a laser beam are holes or orifices 28 which extend uniformly through the top and are of a diameter of 0.003 inches or less. The orifices 28 are arranged in a random pattern as shown in FIG. 2 within the confines of the sealing flange 24. These orifices permit gas to flow between the container and the outside atmosphere to equalize pressure.

As seen in FIG. 1, arrows 30 show venting of gas through these orifices from the inside of the container to atmosphere. This is often desirable as in the case of a product such as a chlorinated product which gives off a gas, building up a small pressure which can be vented through vents 30 to atmosphere. Likewise flow can take place of atmospheric air from the outside of the cap into the container through orifices 28 such as in the case of hot packing of a product in the container so that as the sealed container cools, a vacuum is created drawing air into the container through the orifices 28 from the atmosphere. I have found that a diameter of 0.003 inches or less permit the ready flow of gases through the container top without permitting a liquid product from passing through the top at the same pressure difference. Heretofore, such a venting was not possible since orifice holes of this small of a diameter could not be uniformly machined. With the advent of laser technology, such holes of uniform diameter are readily formed into any common plastic. I have also found that the laser beam can create a hole of 0.001 to 0.002 and that this is satisfactory for venting gases through the container cap. It is also contemplated that orifice holes as small as 0.0005 may be desirable in the packaging of liquids of extremely low viscosity.

I claim:

1. A venting closure for closing a liquid container comprising a cap having a flat top and cylindrical skirt depending therefrom containing means for attachment to a container, said top having at least one cylindrical orifice extending therethrough with a diameter of 0.003 inches or less formed by a laser beam, whereby gas will flow through said orifice when a pressure difference exists between the pressure in said container and atmospheric pressure, but liquid will not pass through said orifice under the action of said pressure difference.

2. The closure of claim 1 wherein the means for attachment to a container includes threads on the inside of said cylindrical skirt which engage complementary threads on the neck of said container.

3. The closure of claim 1 further including means for sealing said cap to said container without obstructing said orifice.

4. The closure of claim 3 wherein said sealing means acts between the top of said cap and the neck of said container.

5. The closure of claim 3 wherein said sealing means includes an annular flange depending from said cap top for engagement with the top surface of said container neck.

6. The closure of claim 5 wherein said top contains a plurality of cylindrical orifices extending therethrough with a diameter of 0.003 inches or less arranged in a random pattern within the area confined by said annular flange.

* * * * *